US005109872A

United States Patent [19]

Conn

[11] Patent Number: 5,109,872

[45] Date of Patent: May 5, 1992

[54] PATIENT LEG SUPPORT

[76] Inventor: David P. Conn, 416 N. Poppy, Lompoc, Calif. 93436

[21] Appl. No.: 648,635

[22] Filed: Jan. 31, 1991

[51] Int. Cl.[5] ..... A61G 15/00; A47C 20/02

[52] U.S. Cl. ..... 128/845; 5/652

[58] Field of Search ..... 128/68, 80 R, 845, 846, 128/869, 870, 882, 80 A, 87 R, 88, 89 R; 269/328; 5/443, 80, 508

[56] References Cited

U.S. PATENT DOCUMENTS

| | | | |
|---|---|---|---|
| 2,492,920 | 12/1949 | Koster | 128/80 R |
| 3,339,544 | 9/1967 | Kravitz | 128/80 R |
| 3,939,829 | 2/1976 | Spann | 128/80 R X |
| 4,276,875 | 7/1981 | Sandegard | 128/89 R |
| 4,327,714 | 5/1982 | Spann | 128/80 A |
| 4,372,299 | 2/1983 | Fixel | 128/882 |
| 4,392,489 | 7/1983 | Wagner, Sr. | 128/80 A |
| 4,520,805 | 6/1985 | St. Vincent et al. | 128/80 R |
| 4,578,833 | 4/1986 | Vrzalik | 128/80 R X |
| 4,805,605 | 2/1989 | Glassman | 128/882 X |
| 4,889,109 | 12/1989 | Gifford | 128/80 R X |
| 4,910,818 | 3/1990 | Grabill et al. | 5/443 |

OTHER PUBLICATIONS

Fred Sammons, Inc., 1990 Healthcare Catalog p. B31 "Dr. Meal's Foot Elevator Blanket Cradle".

*Primary Examiner*—Richard J. Apley
*Assistant Examiner*—Linda C. M. Dvorak
*Attorney, Agent, or Firm*—Robert M. Sperry

[57] ABSTRACT

An improved patient leg support and bedding support frame which serves to elevate the sheets and blankets to prevent their interfering with the patient's leg movements, a leg support member formed of resilient material insertable between a patient's legs to assure maintenance of desired spacing of the legs and pivotally attachable to the frame to enable the patient to turn his legs and body without additional assistance.

10 Claims, 2 Drawing Sheets

PATIENT LEG SUPPORT

RELATED PAPERS

This invention is disclosed in my Disclosure Document No. 250207.

BACKGROUND

This invention relates to leg supports for patients and is particularly directed to means for enabling a patient, who has had a hip replacement or the like, to turn himself in bed without adversely effecting the surgery.

PRIOR ART

Patients, who have undergone hip replacement surgery or the like, must spend considerable time in bed, during their recuperation. During this period, they often tire of lying in one position and desire to turn over or to lie on one side. Such movement serves to relieve the patient's boredom and is necessary to prevent the patient from developing bed sores and the like. Unfortunately, any lateral movement of the patient's leg or joint may adversely effect the healing process or even negate the purpose of the operation. Thus, two nurses are required to assist each time the patient wishes to turn; one to support the patient's leg during the turn, and the other to assist in turning the patient. This causes considerable interference with the nurses' other duties, increases the staffing problems for orthopedic surgery departments and greatly amplifies the patient's feelings of helplessness and dependency at a time when such feelings are the antithesis of the efforts of the medical staff in trying to reassure and encourage the patient. Obviously, it would be extremely helpful if a device could be provided which would enable the patient to turn without assistance, since this would lessen the burden on the nursing staff and would serve to enhance the patient's feeling of independence and self-reliance. Unfortunately, no such device has been available heretofore. Some prior art devices have been available to assure that the patient's leg is maintained in a proper orientation. However, these prior art devices have been in the nature of restraints which inhibit, rather than encourage, turning by the patient whenever the patient wishes to do so and without requiring assistance from nurses or other third parties. Other prior art patient leg supports have been bulky and cumbersome devices which interfere or actually prevent a patient from getting into and out of the bed or turning their bodies by themselves. Thus none of the prior art patient leg supports have been entirely satisfactory.

BRIEF SUMMARY AND OBJECTS OF INVENTION

These disadvantages of the prior art are overcome with the present invention and an improved patient leg support is provided which enables a patient to turn on either side or to turn over at will without requiring any assistance after the first night, yet which assures that the patient's leg is maintained in the proper position at all times. Moreover, the device of the present invention can quickly and easily be attached and detached, whenever desired, to facilitate the patient getting into or out of the bed.

The advantages of the present invention are preferably attained by providing an improved patient leg support comprising a bedding support frame which serves to elevate the sheets and blankets to prevent their interfering with the patient's leg movements, a leg support member formed of resilient material insertable between a patient's legs to assure maintenance of desired spacing of said legs and pivotally attachable to said frame to enable the patient to turn his legs without additional assistance.

Accordingly, it is an object of the present invention to provide an improved patient leg support.

Another object of the present invention is to provide an improved patient leg support which assures maintenance of proper spacing of the patient's legs, yet which enables the patient to turn his legs without additional assistance.

A further object of the present invention is to provide an improved patient leg support which reduces the burden on the nursing staff in assisting patients to turn their legs and bodies.

An additional object of the present invention is to provide an improved patient leg support which enables a patient of lower extremity surgery to turn their legs and body at will, without additional assistance and, thereby, enhances the patient's feeling of independence and self-reliance.

A specific object of the present invention is to provide an improved patient leg support a bedding support frame which serves to elevate the sheets and blankets to prevent their interfering with the patient's leg movements, a leg support member formed of resilient material insertable between a patient's legs to assure maintenance of desired spacing of said legs and pivotally attachable to said frame to enable the patient to turn his legs without additional assistance.

These and other objects and features of the present invention will be apparent from the following detailed description, taken with reference to the figures of the accompanying drawing.

DETAILED DESCRIPTION OF THE INVENTION

Figure 1:
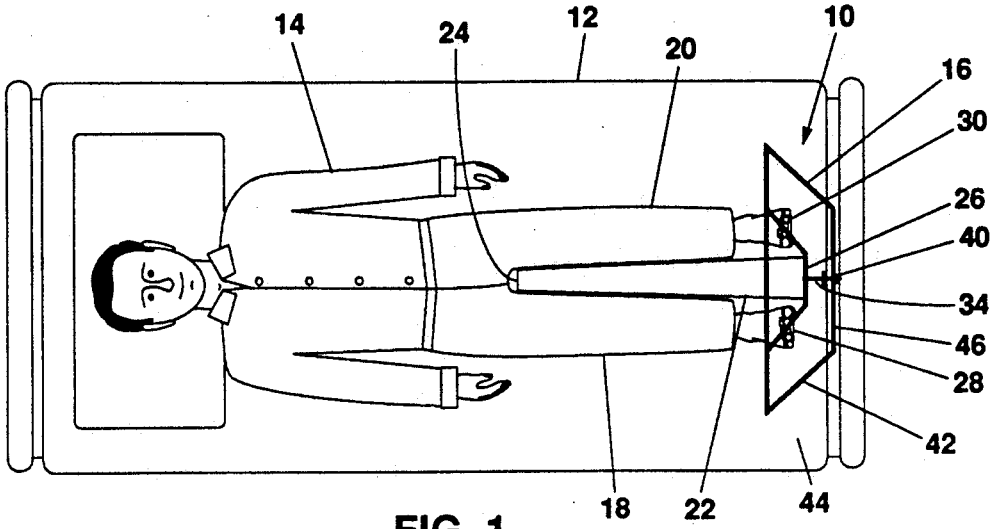
FIG. 1 is a plan view showing a patient using the patient leg support of the present invention, with the bedding removed for clarity.
Figure 2:
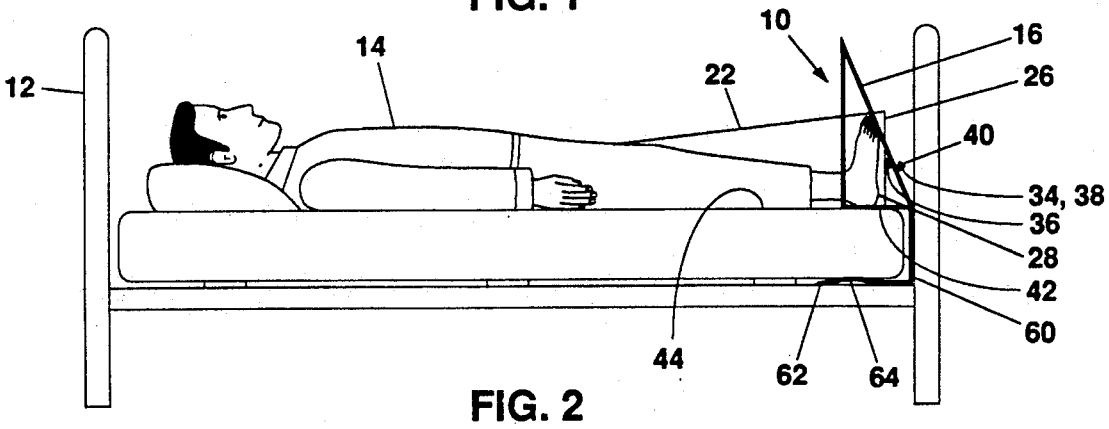
FIG. 2 is a side view of the patient and patient leg support of FIG. 1.
Figure 3:
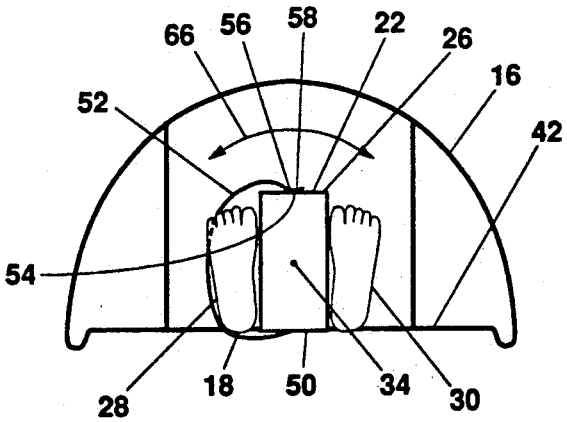
FIG. 3 is a diagrammatic front view showing how the support member of the patient leg support of FIG. 1 serves to enable the patient to turn without additional assistance.
Figure 4:
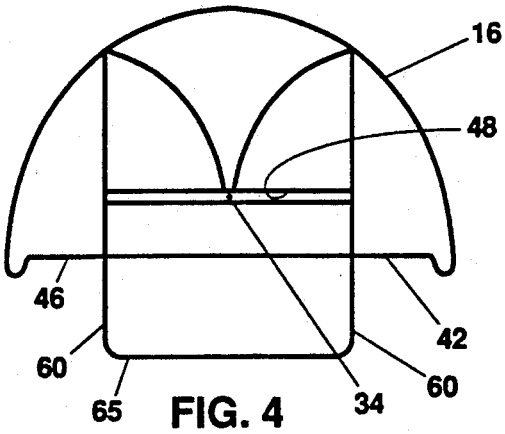
FIG. 4 is a front view of the frame portion of the patient leg support of FIG. 1.
Figure 5:
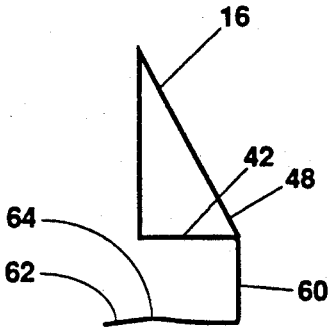
FIG. 5 is a side view of the frame portion of FIG. 4.
Figure 6:
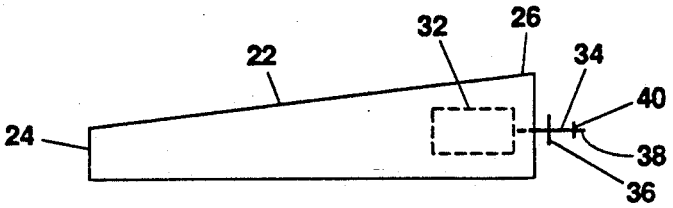
FIG. 6 is a side view of the support member of the patient leg support of FIG. 1.
Figure 7:
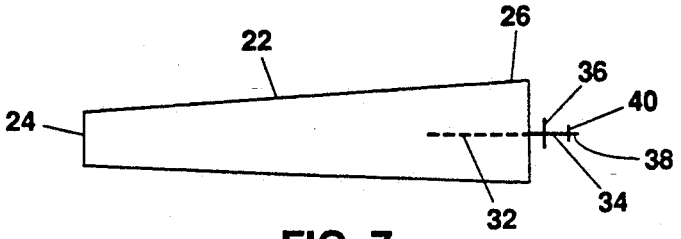
FIG. 7 is a plan view of the support member of FIG. 6.
Figure 8:
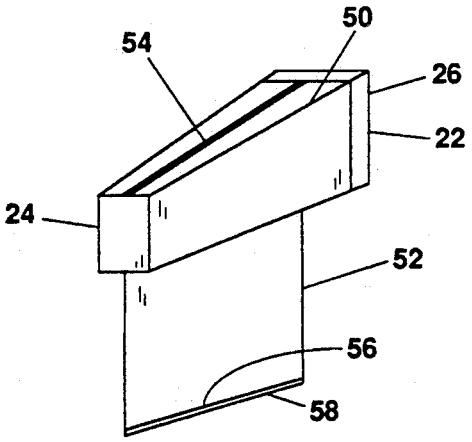
FIG. 8 is an isometric view of the cover for the support member of FIG. 6.
Figure 9:
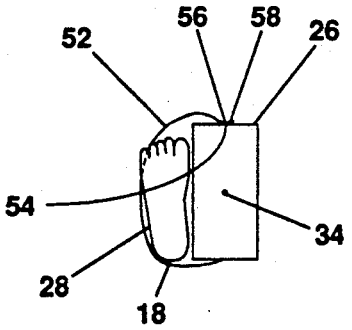
FIG. 9 is an end view showing the cover of FIG. 8 used to releasably secure a patient's leg to the support member of FIG. 6.

In that form of the present invention chosen for purposes of illustration in FIGS. 1 and 2, a patient leg support device, indicated generally at 10, is shown mounted on the mattress 44 of a patient 14. The frame portion 16 of the patient leg support 10 projects upwardly above the patient 14 to elevate the bedding, not shown, so that the bedding will not interfere with movement of the legs 18 and 20 of the patient 14. A leg support member 22 projects between the legs 18 and 20 of the patient 14 and is preferably formed of somewhat resilient material, such as polyurethane foam, so as to be relatively comfortable for the patient 14, yet to provide support for the legs 18 or 20 when the patient desires to change his position in the bed 12. As shown, the leg support member 22 is generally rectangular in cross section and tapers from a small forward end 24 to a larger rear end 26 which is approximately equal in height to the length of the patient's feet 28 and 30. As best seen in FIGS. 6 and 7, the leg support member 22 has a rigid plate 32 embedded therein adjacent the large end 26 and a shaft 34 projects rearwardly from the plate 32 and end 26 of the leg support member 22. The shaft 34 carries a relatively large diameter rigid washer 36 mounted a spaced distance inwardly from the end 38 of the shaft 34 and has a smaller diameter washer 40, formed of resilient material, mounted between the large washer 36 and the end 38 of the shaft 34. As seen in FIG. 4, the frame 16 has a lower horizontal member 42 which rests on the upper surface 44 of the bed 12 and has a second horizontal member 46 mounted slightly above the lower horizontal member 42 to define a space 48 therebetween. The shaft 34 is dimensioned to pass free through the space 48, while small resilient washer 40 is dimensioned to fit frictionally through the space 48 and the large rigid washer 36 is too large to pass through the space 48. This permits the leg support member 22 to be quickly and easily attached to or removed from the frame 16 by pushing shaft 34 and resilient washer 40 through the space 48 and, once attached, to rotate freely within the space 48; while the large washer 36 serves to prevent the large end 26 of the leg support member 22 from engaging the frame 16 during rotation of the leg support member 22, which would interfere with free rotation of the leg support member 22. Finally, as seen in FIGS. 3, 8 and 9, a sleeve 50 is provided configured to correspond to the shape of the leg support member 22 and having a flap 52 projecting from the bottom centerline of the sleeve 50. The sleeve 52 has fastening means 54, such as a strip of hook-and-loop material extending along the upper centerline of the sleeve 50 and mating fastening means 56 are provided on each side of the free edge 58. As best seen in FIGS. 2 and 5, the frame 16 also comprises a generally L-shaped mounting member 60 which extends downwardly from the lower horizontal member 42 and projects forwardly beneath the mattress of the bed 12. Preferably, the forwardly projecting portion 62 of the mounting member 60 is curved, as seen at 64, to facilitate retention of the mounting member 60 in a desired location.

In use, the patient or nurse mounts the frame 16 of the leg support device 10 by sliding the forwardly projecting portion 62 of the mounting member 60 under the mattress of the bed 12, as seen in FIG. 2, Thereafter, when desired, the leg support member 22 may be attached by inserting end 38 of shaft 34 through the space 48 of the frame 16 until the resilient washer 40 has passes the horizontal members 42 and 46 of the frame 16. As noted above, the rigid washer 36 prevents shaft 34 from being inserted far enough to allow the large end 26 of the leg support member 22 to engage the frame 16. The sleeve 50 is then mounted on the leg support member 22 and the flap 52 is passed under the injured leg (leg, 18 and foot 28, as seen in FIGS. 3 and 9) of the patient 14 and the free end 58 of the flap 52 is brought upward and is secured to fastening means 54 on the top of the sleeve 50, by means of fastening means 56. This secures the injured leg 28 to the leg support member 22. When the patient desires to turn on his side, he moves the toes of his feet 28 and 30 in the desired direction, as indicated by arrow 66 in FIG. 3. The toes of the feet 28 and 30 apply pressure to the upper edge of the leg support member 22 and cause the shaft 34 to rotate within the space 48 of the frame 16, allowing the leg support member 22 to rotate in the desired direction. Since the injured leg 18 is secured to the leg support member 22 by flap 52 of the sleeve 50, the injured leg 18 will rotate with the leg support member 22 and will be maintained in the desired orientation, without requiring any assistance from other persons, such as nurses or other personnel. This enables the patient to turn whenever he desires to do so, while assuring that the injured leg 18 will be constantly maintained in the desired orientation, yet without requiring assistance from other persons. This contributes considerably to the patient's feeling of independence and self-reliance and significantly enhances the psychological aspects of his recovery.

Figure 10:
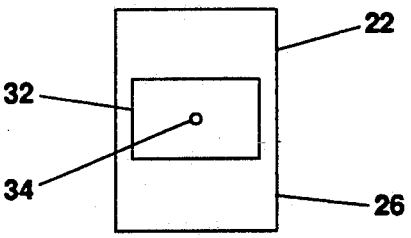
FIG. 10 is a rear end view of an alternative form of the support member of FIG. 6.

FIG. 10 shows an alternative form of the leg support member 22 which is inflatable. As a consequence, the rigid plate 32 must be mounted on the rear end 26 of the leg support member 22 and shaft 34 will project perpendicularly from the plate 32. Functionally, this form of the leg support member 22 will be identical to that of FIGS. 1-9.

Obviously, numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A leg support device comprising:

a frame mountable on a patient's bed to prevent bedding from interfering with movement of the patient's legs, said frame comprising a pair of horizontal members defining a space therebetween, a leg support member releasably attachable to said frame and freely rotatable with respect to said frame, said leg support member being positionable between the patient's legs to assure maintenance of proper orientation of an injured leg while the patient is turning, a shaft projecting from the rear end of said leg support member and dimensioned to pass freely through said space, a rigid washer mounted on said shaft and spaced a predetermined distance from the end of said shaft to prevent said leg support member from engaging said frame during rotation, and a resilient washer mounted between said rigid washer and the end of said shaft and dimensioned to frictionally pass through said space to permit releasable attachment of said leg support member to said frame.

2. The leg support device of claim 1 further comprising:

means for releasably securing an injured leg to said leg support member.

3. The leg support device of claim 1 wherein:
said leg support member is formed of resilient material.

4. The leg support device of claim 1 wherein:
said leg support member is formed of polyurethane foam.

5. The leg support device of claim 1 wherein:
said shaft projects from a rigid plate embedded within said leg support member.

6. The leg support device of claim 1 wherein:
said shaft projects perpendicularly from a plate mounted on one end of said leg support device.

7. The leg support device of claim 2 wherein:
said means for securing the patient's leg to said leg support member is a sleeve covering said leg support member and formed with a flap projecting from the bottom of said sleeve and having means for releasably fastening the free end of said flap to the top of said sleeve with said flap extending about the injured leg.

8. The leg support device of claim 1 wherein:
said leg support member is inflatable.

9. A leg support device comprising:
a frame mountable on a patient's bed to prevent bedding from interfering with movement of the patient's legs, said frame comprising a pair of horizontal members defining a space therebetween,
a leg support member releasably attachable to said frame and freely rotatable with respect to said frame, said leg support member being positionable between the patient's legs to assure maintenance of proper orientation of an injured leg while the patient is turning, and
a shaft projecting from a rigid plate embedded within the rear end of said leg support member and dimensioned to pass freely through said space.

10. The leg support device of claim 9 wherein:
said shaft projects perpendicularly from a plate mounted on the rear end of said leg support device.

* * * * *